United States Patent [19]

Arendt et al.

[11] 4,201,363

[45] May 6, 1980

[54] TUBING RETRIEVABLE SURFACE CONTROLLED SUBSURFACE SAFETY VALVE

[75] Inventors: Henry P. Arendt; Thomas M. Deaton; Gary A. Kohn, all of Dallas, Tex.

[73] Assignee: Otis Engineering Corporation, Dallas, Tex.

[21] Appl. No.: 925,535

[22] Filed: Jul. 17, 1978

[51] Int. Cl.[2] ..... F16K 31/122; E21B 33/00

[52] U.S. Cl. ..... 251/62; 251/89.5; 137/71; 166/322; 166/323; 166/324

[58] Field of Search ..... 137/71; 166/322, 323, 166/324; 251/89.5, 62

[56] References Cited

U.S. PATENT DOCUMENTS

| | | | |
|---|---|---|---|
| 3,696,868 | 10/1972 | Taylor, Jr. | 166/322 |
| 3,762,471 | 10/1973 | Mott | 166/322 |
| 3,763,933 | 10/1973 | Mott | 166/322 |
| 3,799,258 | 3/1974 | Tausch | 166/322 X |
| 3,856,083 | 12/1974 | Mott | 166/322 |
| 3,870,102 | 3/1975 | Mott | 166/322 X |
| 3,882,935 | 5/1975 | Calhoun | 166/322 |
| 3,990,511 | 11/1976 | Gazda | 166/322 |

*Primary Examiner*—Arnold Rosenthal
*Attorney, Agent, or Firm*—Vinson & Elkins

[57] ABSTRACT

Disclosed is a tubing retrievable surface controlled subsurface safety valve having provisions for blocking communication of control fluid to the valve's pressure responsive operator and for locking the valve open in the event of valve failure. This abstract of the disclosure is neither intended to define the scope of the invention which, of course, is measured by the claims nor is it intended to limit the invention in any way.

12 Claims, 15 Drawing Figures

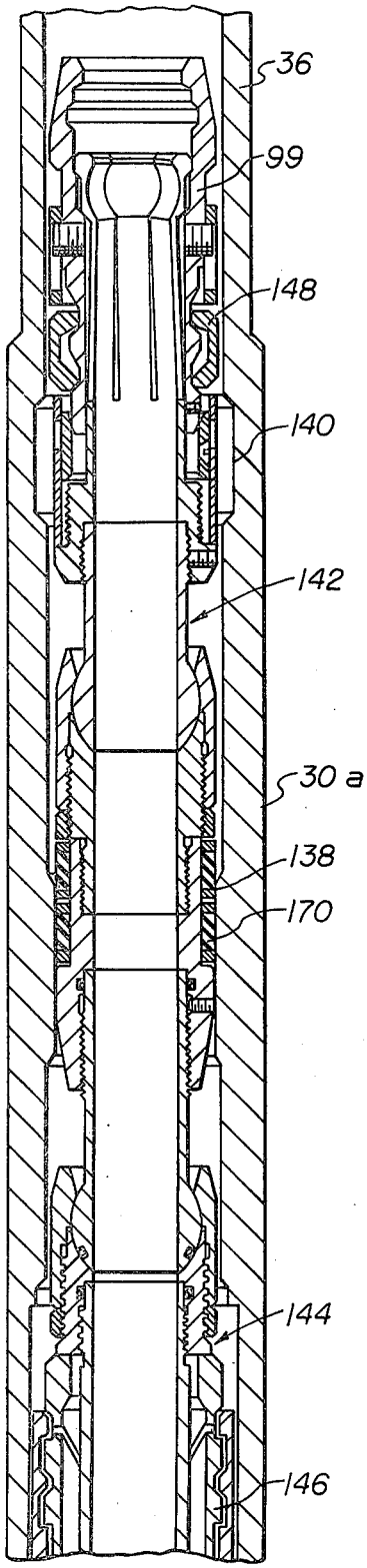
fig. 2A
fig. 2B
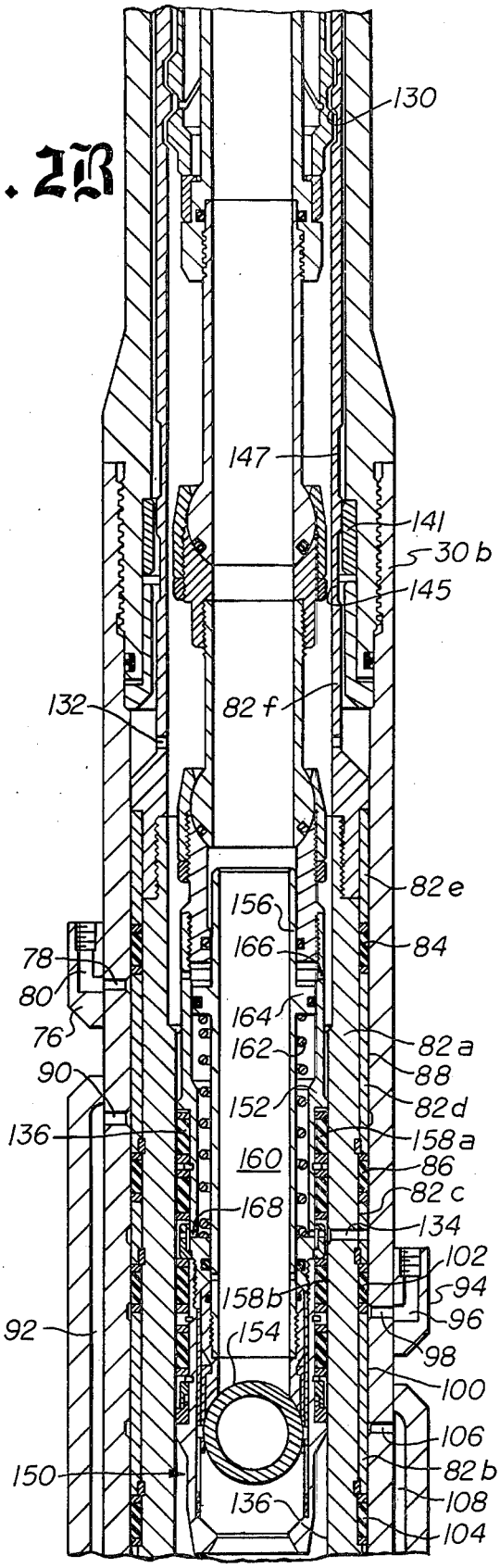

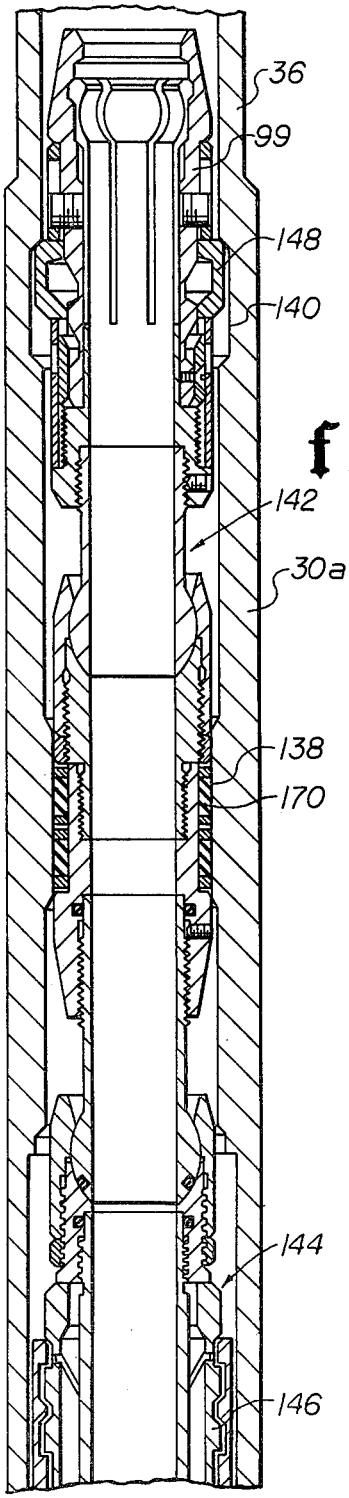
fig.3A
fig.3B
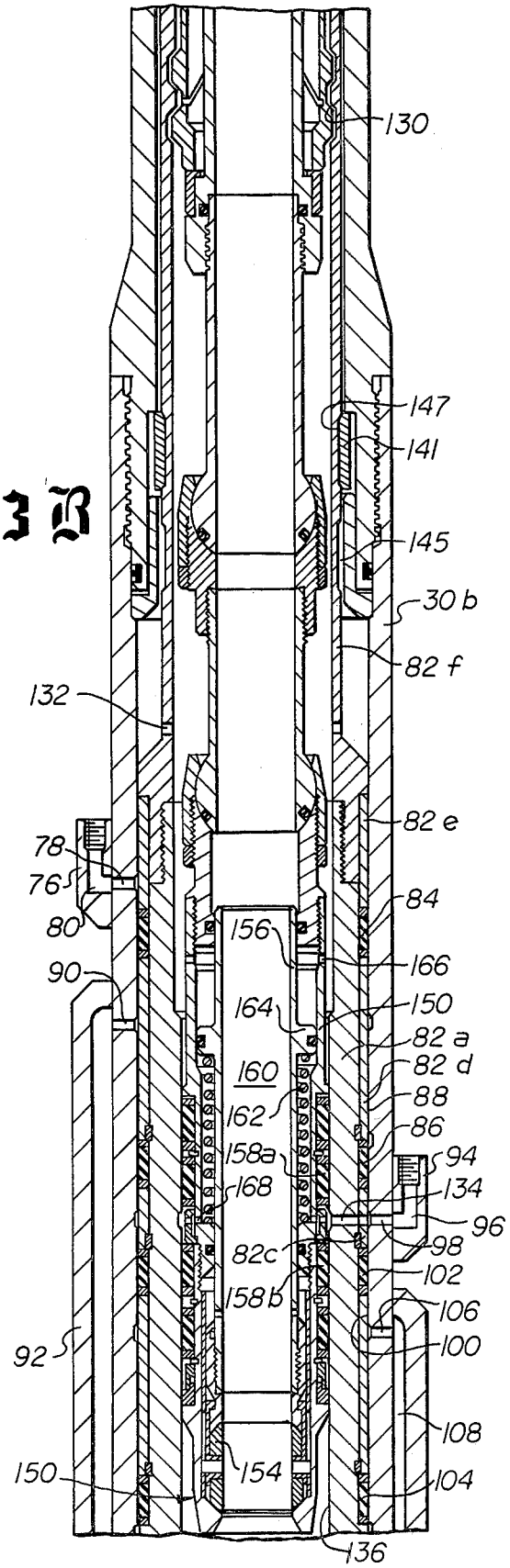

TUBING RETRIEVABLE SURFACE CONTROLLED SUBSURFACE SAFETY VALVE

BACKGROUND OF THE INVENTION

1. Field of the Invention

This invention relates to tubing retrievable surface controlled subsurface safety valves for controlling flow at a subsurface location in a well.

2. The Prior Art

Surface controlled subsurface safety valves have been used to control flow in a well at a subsurface location for some time. Some such valves are tubing retrievable. (See U.S. Pat. Nos. 3,860,066; 3,007,669 and 2,894,715.) The valve forms an integral portion of the tubing string. In the event of a malfunction, replacement of the valve requires retrieval of the tubing string and placement of a new valve therein.

To avoid retrieval of the tubing string and replacement of the malfunctioned tubing retrievable valve, some tubing retrievable valves are adapted to be locked open. Thereafter, a second wire line or pumpdown retrievable valve is landed in the tubing string and that second valve controls subsurface fluid flow. (See U.S. Pat. Nos. 3,696,868; 3,762,471; 3,856,083; 3,870,102; and 3,882,935.) To reduce the complexity of the well's hydraulic control system, it is desirable to operate the second valve utilizing the same conduits that had been used to communicate control fluid to the malfunctioned tubing retrievable valve. However, if the seals which render the tubing retrievable valve control pressure responsive fail, remedial operations, such as installing a wireline or pumpdown retrievable valve, could prove ineffective. First, if leakage past the seals is severe, the hydraulic control system will not be able to control the second valve. Seal leakage prevents the obtainment of sufficient pressure to open the second valve and maintain it opened. Second, high pressure well fluids may escape from the tubing string bore past the failed seals. A well blowout could thereby be initiated.

The well's tubing string may be equipped with a special landing nipple and a control conduit terminating at the landing nipple. The landing nipple may include a sleeve valve to control fluid communication from the control conduit. A wireline retrievable valve may be landed, locked, and sealed in the landing nipple and simultaneously the sleeve valve is shifted to permit control fluid from the control conduit to be effective to control the valve. (See U.S. Pat. No. 3,990,511.)

A sleeve valve (as disclosed in the Composite Catalog of Oil Field Equipment and Services, 1976–77 Ed. pp. 4572 and 4574) may be shifted to isolate the operating seals of a tubing retrievable surface controlled subsurface safety valve. However, for a subsurface safety valve structured in accordance with that disclosure, separate trips and different operating tools are required to lock the safety valve in an open position, block passage of control fluid to the operating seals, and land a secondary valve in the tubing string bore.

OBJECTS OF THE INVENTION

An object of this invention is to provide a tubing retrievable surface controlled subsurface safety valve which can be locked in the open position and isolated from the control conduit with a single trip of an operating tool.

Another object of this invention is to provide a tubing retrievable surface controlled subsurface safety valve which can be locked open and isolated from both a balance conduit and a control conduit with a single trip of an operating tool.

Another object of this invention is to provide a tubing retrievable surface controlled subsurface safety valve which, upon being locked open and isolated from the control conduit in a single operation, receives a second valve and permits surface control of that second valve with the same control conduit(s) which formerly controlled the tubing retrievable valve.

These and other objects and features of advantage of this invention will be apparent in the drawings, the detailed description, and the appended claims.

BRIEF DESCRIPTION OF THE DRAWINGS

In the drawings, wherein like numerals indicate like parts, and wherein an illustrative embodiment of this invention is shown:

FIGS. 2A, 2B, 2C and 2D are continuation views, in section, of a tubing retrievable valve structured in accordance with a first embodiment of this invention with the valve closed;

FIGS. 3A, 3B, 3C and 3D are continuation views in section of the valve of FIGS. 2A, 2B, 2C and 2D with the valve locked open and a second valve landed therein;

DETAILED DESCRIPTION OF THE PREFERRED EMBODIMENT

Figure 1:
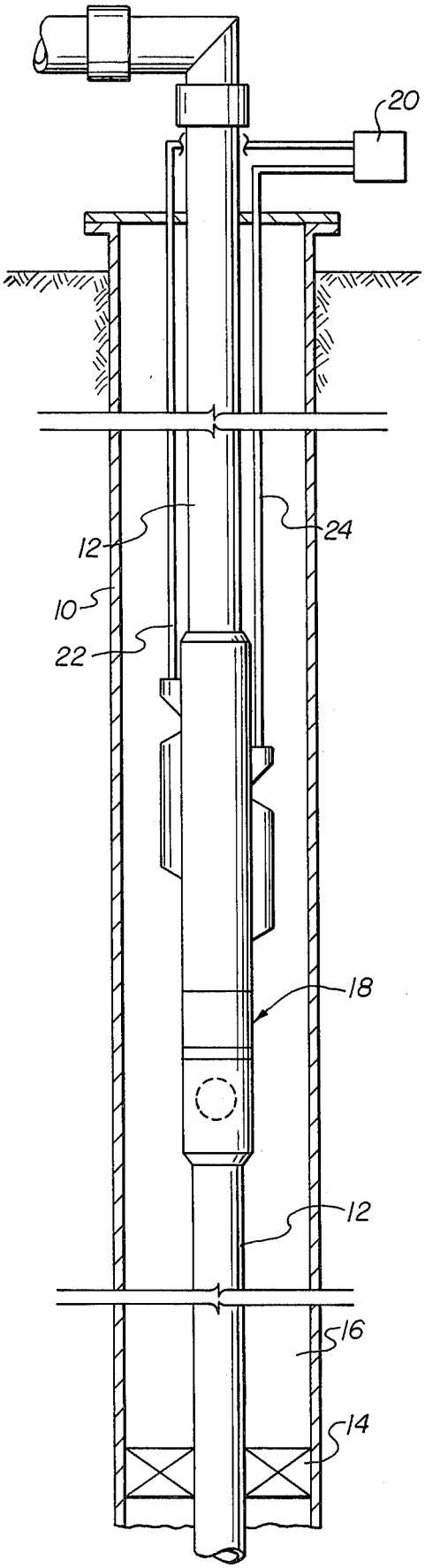
FIG. 1 is a schematic illustration of a well installation incorporating a tubing retrievable surface controlled subsurface safety valve structured in accordance with this invention.
Figure 4:
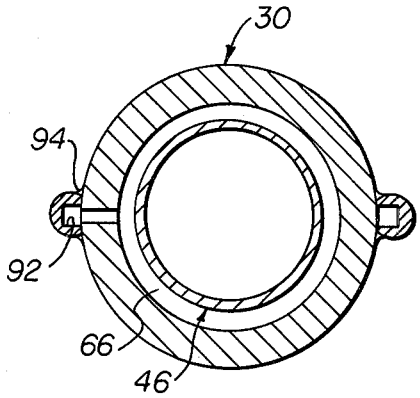
FIG. 4 is a view taken along line 4—4 of FIG. 3.
Figure 5:
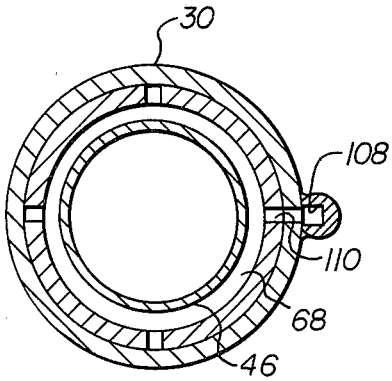
FIG. 5 is a view taken along line 5—5 of FIG. 3.
Figure 2C:
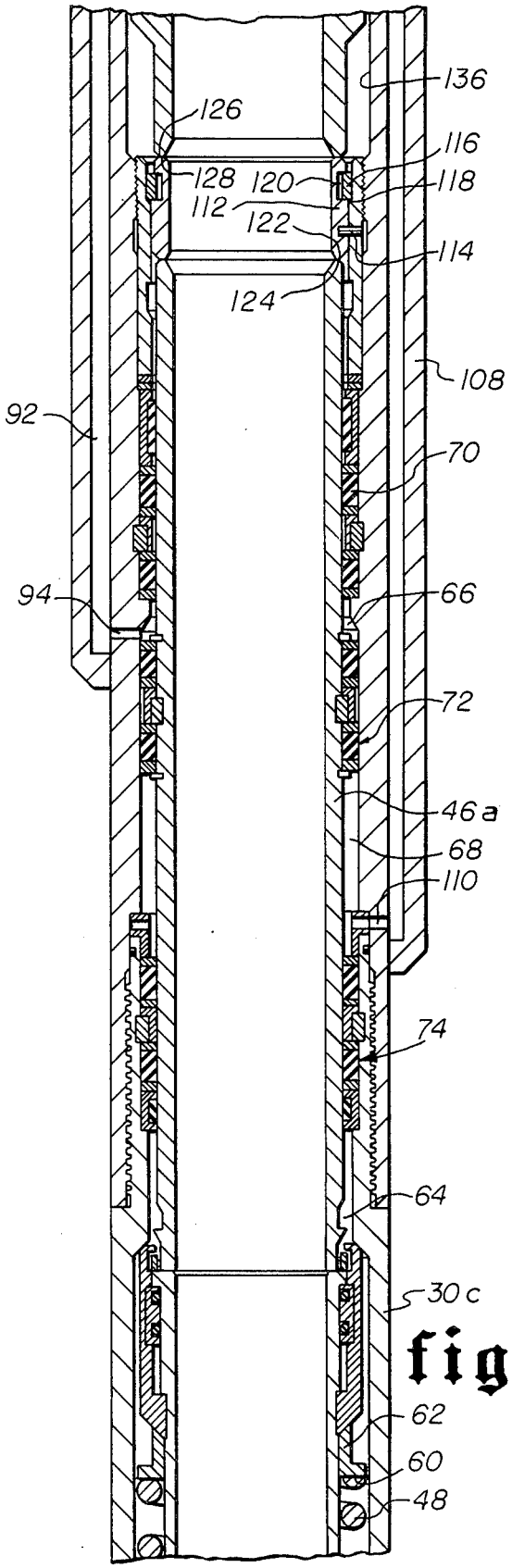
Figure 2D:
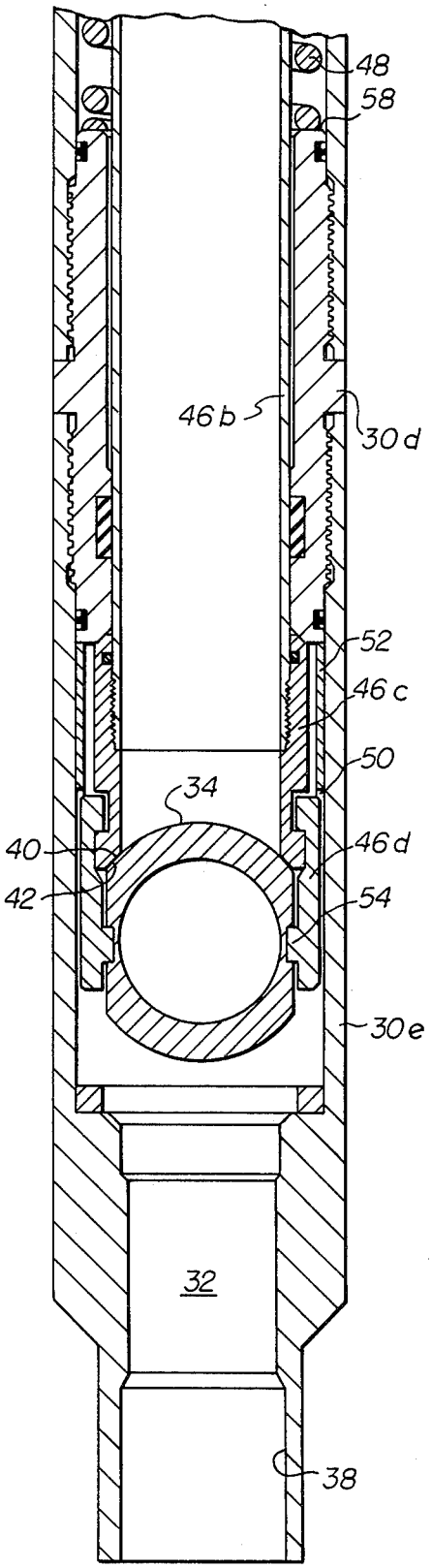
Figure 3C:
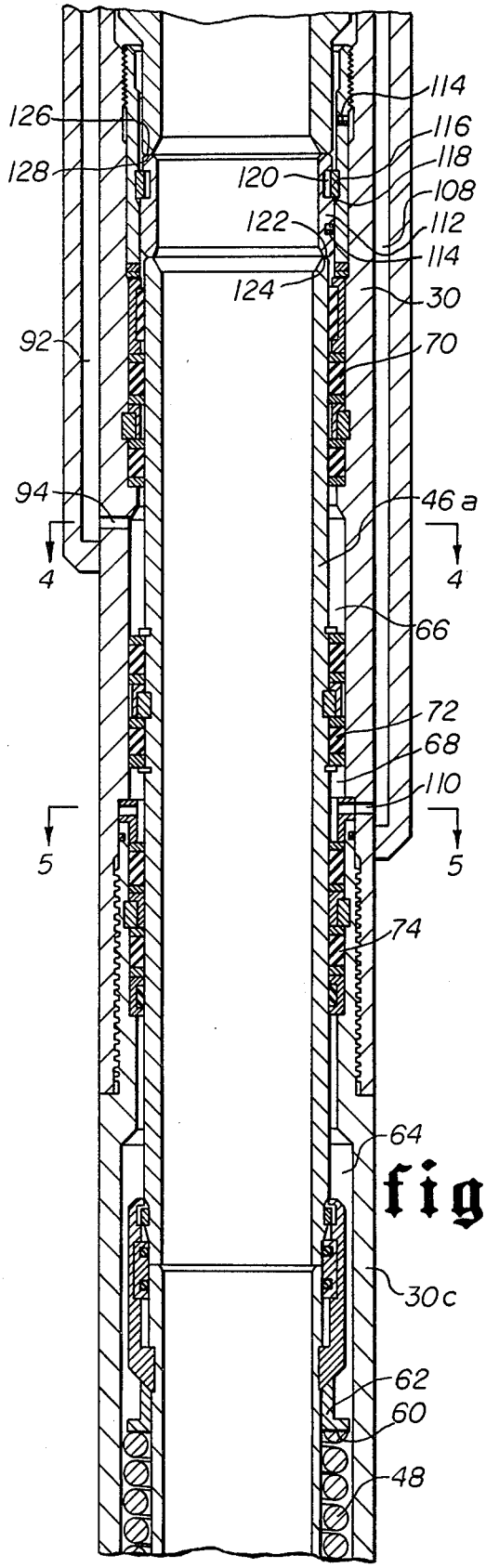
Figure 3D:
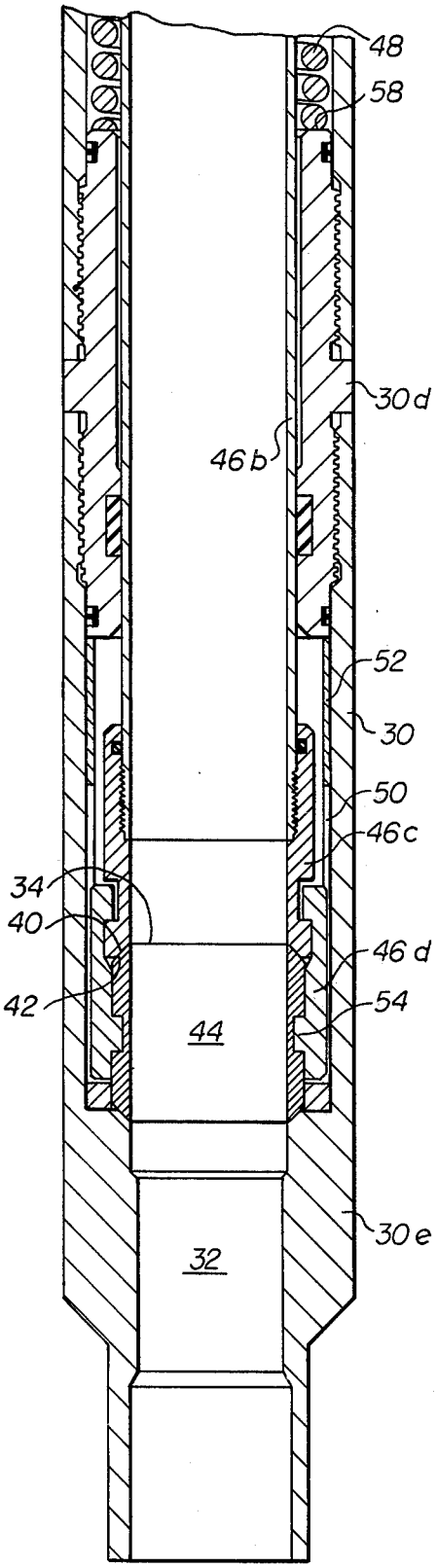
Figure 6A:
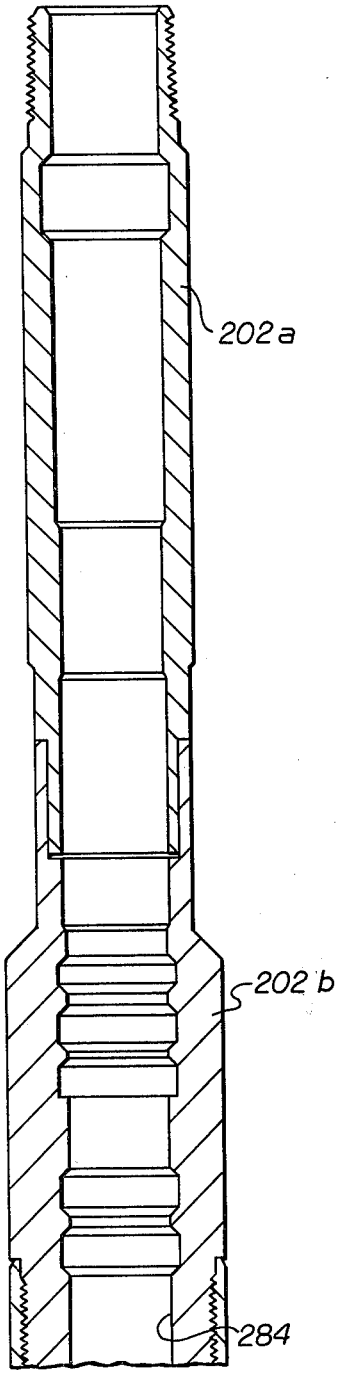
FIGS. 6A, 6B, 6C and 6D are continuation views, in section, of a tubing retrievable valve structured in accordance with a second embodiment of this invention with the valve open.
Figure 6B:
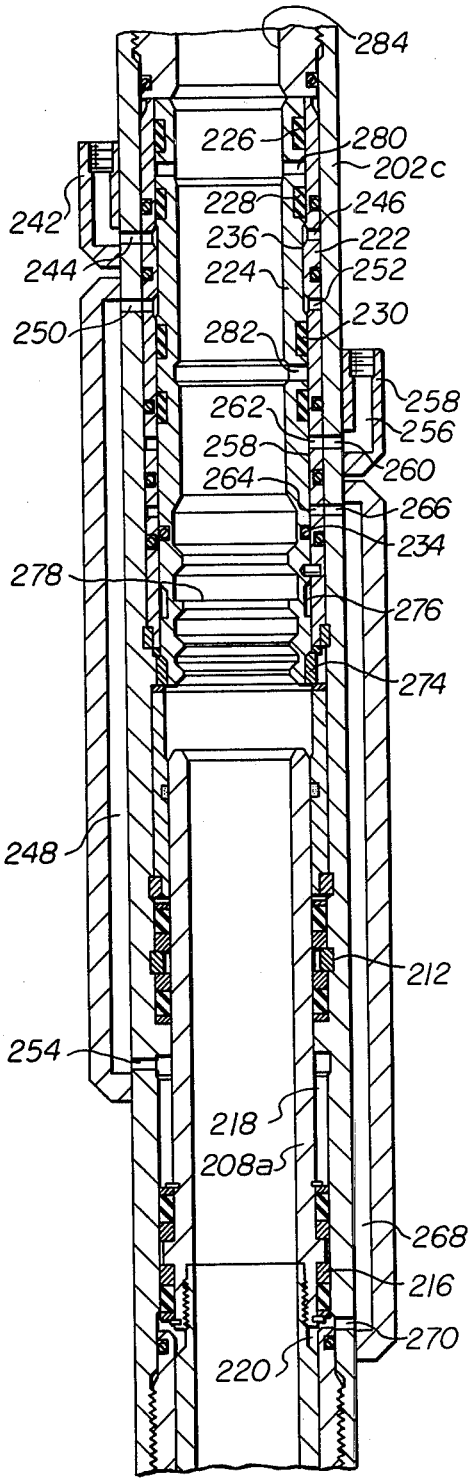
Figure 6C:
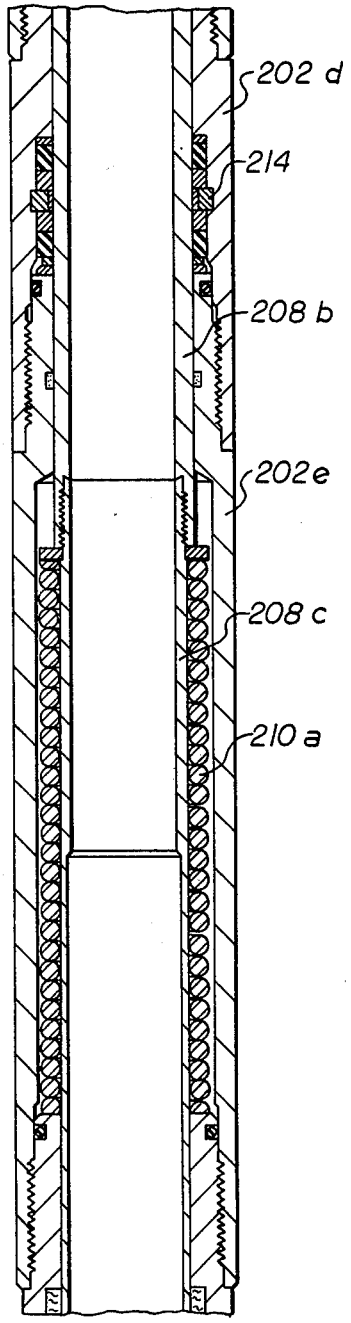
Figure 6D:
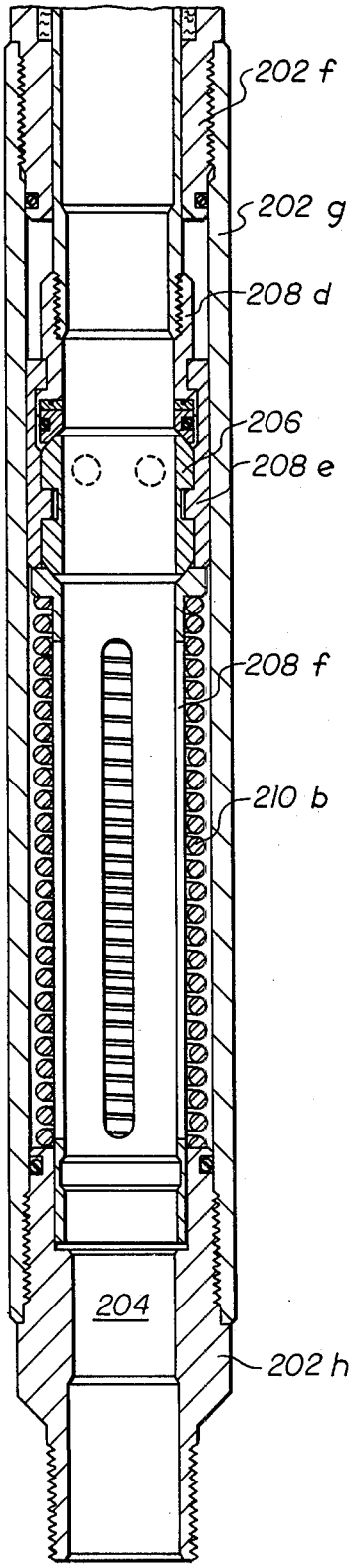

A well may be equipped with a tubing retrievable valve to control flow at a subsurface location. One such well installation is illustrated schematically in FIG. 1. The well is cased with the casing string 10. Through the casing string 10 extends a tubing string 12. Above the producing formation (not shown) packer means 14 packs off the annulus 16 between the tubing string 12 and the casing string 10 to confine fluid flow to the bore extending through the tubing string 12. Subsurface flow through the tubing string bore is controlled by a tubing retrievable safety valve 18. Valve 18 is in turn controlled from the wellhead surface. Conduit means extend between the subsurface valve 18 and the wellhead surface. Operating manifold 20 pressurizes hydraulic control fluid and pumps it into the conduit means to control the subsurface valve 18. In the illustrated well installation, one conduit means 22 is a control conduit. When control fluid within the control conduit 22 is pressurized at least to a selected value, the subsurface safety valve 18 opens. When the control fluid pressure is reduced below a select value, the valve 18 closes. The other conduit means 24 is a balance conduit. The residual hydrostatic pressure of fluid within control conduit 22 is balanced by the presence of fluid within balance conduit 24. Additionally, closure of the valve 18 may be assisted by pressurizing the fluid within balance conduit 24.

During the life of the well installation, it is possible that the subsurface valve 18 will malfunction. One possible malfunction is failure of the seals which render the subsurface valve 18 control pressure responsive. Such seal failure may open a flow path through which high pressure well fluids can escape from the tubing string bore. If high pressure well fluids do thereby escape, a well blowout could be initiated. Additionally, if a second valve is landed in the malfunctioned tubing retrievable valve 18, it may be impossible to control that second valve with the same conduit means which controlled the malfunctioned tubing retrievable valve. The control difficulties arise because of an inability to maintain adequate control fluid pressure. The pressurized control fluid simply escapes by leaking past the failed seals.

The tubing retrievable surface controlled subsurface safety valve 18 of this invention does not have these limitations. In the event its operating seals fail, the valve 18 is locked in its open position. Simultaneously, the operating seals are isolated from the conduit means 22 and 24. Thereafter, even if well fluids leak past the failed operating seals, the well fluids cannot blowout through the conduit means. Additionally, control fluid is directed to a second valve which has been landed in the locked out malfunctioned valve 18. Thus, the same conduit means which controlled the tubing retrievable valve 18 prior to its malfunctioning, controls the secondary valve. Utilizing a tubing retrievable valve 18 structured in accordance with this invention, the three operations of locking out the malfunctioned valve, isolating the failed operating seals from the control conduit means and landing the secondary valve are all performed in one trip of an operating tool train.

The details of a first embodiment of a tubing retrievable surface controlled subsurface safety valve structured in accordance with this invention are illustrated in FIGS. 2 through 5. In FIGS. 2A through 2D the valve is closed. In FIGS. 3A through 3D, the valve is illustrated in its locked open configuration with a secondary valve landed therein.

The subsurface safety valve 18 includes housing means 30 for defining the controlled subsurface flow path 32. Closure means 34 controls flow through the flow path 32. Pressure responsive actuator means moves the closure means 34. Communicating means extend between the conduit means 22 and 24 and a region within the valve 18 wherein the control fluid can affect the actuator means. If the safety valve 18 malfunctions, shiftable means simultaneously lock the safety valve 18 open and align the communicating means to block passage of control fluid between the conduit means 22 and 24 and the actuator means. If desired, the configuration of the communicating means may permit control fluid passage to a secondary valve. Thereafter, that second valve can be controlled by pressurization of fluid within the same conduit means 22 and 24 which were relied upon to control the now malfunctioned, tubing retrievable valve 18.

Housing means 30 is adapted to be made up with the tubing string 12 and form a portion thereof. Housing means 30 includes longitudinally extending bore means 32 which is aligned with and communicates with the bore extending through the tubing string 12. When housing means 30 is made up in the tubing string 12, bore means 32 defines the controlled subsurface flow path. The illustrated housing means 30 is formed from interconnected tubular sections **30*a*, 30*b*, 30*c*, 30*d*, 30*e* and 30*f*. The upper tubular section 30*a* includes means 36 for connection with the tubing string 12 extending upwardly in the well installation and the lower tubular section 30*f* also includes means 38 for connecting with tubing string 12** extending downwardly in the well installation.

Closure means 34 (see FIGS. 2D and 3D) controls flow through the controlled flow path 32. Closure means 34 is movable between a first position closing the flow path 32 (see FIG. 2D) and a second position opening the subsurface flow path (see FIG. 3D). The illustrated closure means 34 is an axially movable and rotational ball valve element 34. It includes a spherical sealing surface 40 for sealingly engaging a complementary seat means 42 when the element 34 is in its first position. The ball valve element 34 also includes passage means 44 which is aligned with the flow path 32 when the element 34 is in its second position. Movement of the closure means 34 between its first, flow path closing position and its second, flow path opening position occurs upon longitudinal movement of the closure means 34 with respect to housing means 30. During longitudinal movement of the closure means 34 with respect to housing means 30, closure means 34 rotates. When the closure means 34 is in its first position, the passage means 44 is not aligned with the flow path 32. When the closure means 34 is in its second position, the passage means 44 is aligned with the flow path.

Pressure responsive actuator means controls movement of the closure means 34. The actuator means is normally in a first position maintaining the closure means 34 in its first position. The actuator means is movable to a second position whenever the control fluid within control conduit means 22 is pressurized at least to a select value. Movement of the actuator means to its second position moves the closure means 34 to its second position. If actuator means is maintained in its second position, the closure means 34 is also maintained in its second position. The actuator means may be balanced with respect to hydrostatic fluid pressure forces. That is, the sensed pressure of control fluid within control conduit means 22 at the subsurface valve 18 includes a hydrostatic pressure due to the weight of fluid within the control conduit 22 and an induced pressure due to operating manifold 20. The hydrostatic pressure is balanced by a corresponding column of fluid within balance conduit means 24. The net pressure force affecting actuator means is therefore the induced pressure of operating manifold 20.

The pressure responsive actuator means comprises movable operator means 46, yieldable urging means 48 for urging the actuator means towards its first position, and pressure responsive means for moving the actuator means to its second position.

Operator means 46 is longitudinally movable with respect to housing means 30. In a first position of operator means 46 the closure means 34 is maintained in its first position. In the second position of operator means 46, closure means 34 is maintained in its second position. Operator means 46 comprises interconnected control tube sections **46*a* and 46*b*, seat member means 46*c* and control finger means 46*d*. Control finger means 46*d* are confined rotationally within a guide slot 50 formed in guide sleeve 52. Control finger means 46*d* include projecting pin means 54 which project into pivot bore means 56 formed in the ball valve element 34. The projecting pin means 54 provide a pivot axis for the ball valve element 34**. The confinement of the control finger means 46*d* within the guide slot 50 assures that the pivot axis remains perpendicular to the longitudinal center line through housing means 30.

Yieldable urging means 48 yieldably urges operator means 46 towards its first position. When the pressure of control fluid within control conduit means 22 is below a select value, yieldable urging means 48 moves and maintains operator means 46 in its first position. When the control fluid within control conduit means 22 is pressurized at least to a select value, the yieldable urging means 48 is overpowered. Operator means 46 is moved and maintained in its second position. The yieldable urging means 48 may comprise the illustrated coil compression spring means. Spring means 48 is disposed between an upwardly facing shoulder 58 associated with housing means 30 and a downwardly facing shoulder 60 formed on ring means 62 and associated with operator means 46.

Pressure responsive means moves operator means 46 to its second position. Between operator means 46 and housing means 30 and surrounding the control tube section 46*a* is an annulus 64. Two pressure chambers 66 and 68 are formed in the annulus 64. One pressure chamber 66 is normally affected by the pressure of fluid within control conduit means 22. The other pressure chamber 68 is normally affected by the pressure of fluid within balance conduit means 24. Seal means 70 and seal means 72 define the one pressure chamber means 66. Seal means 70 is carried by housing means 30 and seals between housing means 30 and operator means 46. Seal means 72 is carried by operator means 46 and seals between housing means 30 and operator means 46. The difference between the seal effective areas of seal means 70 and seal means 72 and the pressure of fluid within chamber means 66 creates a pressure force which is exerted upon operator means 46 and which is proportional to the pressure of fluid within pressure chamber means 66 and which tends to urge operator means 46 towards its second position. Seal means 72 and seal means 74 define the other pressure chamber means 68. Seal means 74 is carried by housing means 30 and seals between housing means 30 and operator means 46. The difference between the seal affected areas of seal means 72 and seal means 74 and the presence of fluid pressure within chamber means 68 results in a pressure force being exerted upon operator means 46 which is proportional to the pressure of fluid within pressure chamber means 68 and which tends to urge operator means 46 towards its first position. Usually, the seal affective areas of seal means 70 and seal means 74 are equal. The net pressure force upon operator means 46 would thus depend upon the greater of the pressure of fluid within pressure chamber means 66 and the pressure of fluid within pressure chamber means 68. To move operator means 46 to its second position, fluid within control pressure chamber means 66 is pressurized at least to a select value. The hydrostatic pressure force within control pressure chamber means 66 is balanced by a corresponding hydrostatic pressure force being affective within balance pressure chamber means 68. Since the seal affective area of seal means 70 and 74 are equal, operator means 46 is pressure balanced with respect to well fluids flowing through the flow path 32.

Communicating means communicate fluid between the conduit means and the pressure responsive means of the safety valve 18. The communicating means extending between the control conduit 22 and the control pressure chamber means 66 and the communicating means extending between the balance conduit 24 and the balance pressure chamber means 68 are similar. The control fluid communicating means is offset longitudinally from the balance fluid communicating means so that fluids from the control conduit 22 and balance conduit 24 do not co-communicate. Nipple means 76 is formed on the exterior of housing means 30. The lower end of control conduit means 22 interconnects with nipple means 76. Port means 78 extend laterally through housing means 30 and communicate with the internal passage 80 of nipple means 76. Sleeve means 82 is disposed within housing means 30 and spans the interior opening of port means 78. Longitudinally spaced seal means 84 and 86 are carried by sleeve means 82. Longitudinal channel means 88 are formed within sleeve means 82 and extend between seal means 84 and 86. Seal means 84 and 86 seal between sleeve means 82 and housing means 30 and initially confine fluids from control conduit means 22 to channel means 88. Port means 90 extend laterally through housing means 30 and open between spaced seal means 84 and 86 in channel means 88. Duct means 92 is formed on housing means 30 and extends longitudinally from port means 90 to a position adjacent control pressure chamber means 66. Lateral port means 94 extends through housing means 30 and communicates between duct means 92 and control pressure chamber means 66. Thus, when the safety valve 18 is initially positioned in the well, control fluid communicates between control conduit means 22 and control pressure chamber means 66 through nipple means 76, port means 78, channel means 88, port means 90, duct means 92 and port means 94. For communicating between balance conduit means 24 and balance pressure chamber means 68, there is nipple means 94 attached to housing means 30 and having an internal passage 96; laterally extending port means 98 in housing means 30, and communicating with passage 96, and initially opening in channel means 100 formed in sleeve means 82; spaced seal means 102 and 104 for initially confining fluid to channel means 100; laterally extending port means 106 in housing means 30 and opening in channel means 100; duct means 108 extending between port means 106 and a position adjacent to balance pressure chamber means 68; and laterally extending port means 110 in housing means 30 and communicating between balance pressure chamber means 68 and duct means 108.

In the event that valve 18 malfunctions, it includes means for simultaneously locking the closure means 34 in its second position and for valving the communicating means to block fluid communication between the control conduit means and the pressure responsive means.

To lock the closure means 34 in its second position, operator means 46 is engaged, moved to its second position, and locked in its second position. The simultaneous locking and valving means includes sleeve means 112 for engaging, moving and locking operator means 46 in its second position. Sleeve means 112 is initially held in a first position where it does not interfere with the normal movement and operation of operator means 46. Sleeve means 112 is shiftable to a second position. Upon such shiftable movement, sleeve means 112 becomes locked in its second position. During such shifting, sleeve means 112 moves operator means 46 to its second position. Means for releasably maintaining sleeve means 112 in its initial position are provided by shear pin means 114. Means for locking sleeve means 112 in its second position are provided by contractable lock ring means 116. Lock ring means 116 is carried in a radially inwardly facing groove means 118 formed in housing means 30. Sleeve means 112 has formed therein a radially outwardly facing recess means 120. When sleeve means 112 is in its second position, lock ring means 116 contracts into recess means 120. A portion thereof remains disposed within groove means 118. The square shoulders defining the longitudinal ends of lock ring means 116, groove means 118 and recess means 120 thereafter prevent relative longitudinal movement between sleeve means 112 and housing means 30. When sleeve means 112 is in its initial, first position, the upwardly facing upper end 122 of operator means 46 may abut the downwardly facing lower end 124 of sleeve means 112. During movement of sleeve means 112 from its first position to its second position, the lower end 124 thereof would engage the upper end 122 of operator means 46. Operator means 46 would be pushed to its second position. Once sleeve means 112 is locked in its second position, operator means 46 is also locked in its second position as is closure means 34. The safety valve 18 is in what is commonly referred to as the locked open position.

Isolation valve means is movable to a position blocking fluid communication between the control conduit means and the pressure responsive actuator means of the safety valve 18. Initially isolation valve means is in a first position permitting communication between the control conduit means and the pressure responsive actuator means. Movement of isolation valve means to a second position blocking such fluid communication occurs upon movement of lock sleeve means 112 to its second position. The illustrated valve means comprises sleeve means 82 and the spaced seal means 84, 86, 102 and 104. When isolation valve means is in its second position, seal means 84 is disposed between port means 78 and 90 and prevents fluid communication between the control conduit 22 and the control pressure chamber means 66. Seal means 86 is between port means 90 and port means 98 and prevents fluid communication between balance conduit means 24 and the control pressure chamber means 66. Seal means 102 is between port means 98 and port means 106 and prevents fluid communication between balance conduit means 24 and balance pressure chamber means 68. For the illustrated valve means, sleeve means 82 includes valve mandrel section 82*a;* spacer sections 82*b,* 82*c,* 82*d* and 82*e;* and profile sleeve 82*f.*

Lock sleeve means 112 and the sleeve means 82 of isolation valve means are simultaneously moved from their respective first positions to their respective second positions. The simultaneous movement occurs because lock sleeve means 112 and valve sleeve means 82 abut when both are in their respective first positions. The upper end 126 of lock sleeve 112 abuts the lower end 128 of valve sleeve means 82. Movement of valve sleeve means 82 towards its second position causes valve sleeve means 82 to push lock sleeve means 112 to its second position.

Sleeve means 82 includes an inwardly facing profile 130 configured to mate with the outwardly facing profile of a shifting tool means. When it is desired to move the valve means to its second position and lock the safety valve 18 open, a shifting tool means is run down the tubing string bore until the tool engages the profile 130. A downwardly acting force is exerted upon the shifting tool means. Shear pin means 114 shears. Valve sleeve means 82 and lock sleeve means 112, are moved from their initial position to their second position. The safety valve 18 is locked open and the pressure responsive actuator means is isolated from the control conduit means 22 and 24.

Once the safety valve 18 is locked open and its pressure responsive actuator isolated from the control conduit means 22 and 24, it may be desired to position a secondary valve in the tubing string bore and operate that valve in response to pressurization of control fluid within the same conduit means 22 and 24 which formerly controlled the safety valve 18. To so operate a second valve, the valve means includes means for permitting control fluid communication between the control conduit means 22 and 24 and the flow path 32 through the safety valve 18. For the illustrated safety valve 18, sleeve means 82 includes laterally extending port means 132 and 134 for communicating between conduit means 22 and 24, respectively, and the flow path 32. Such fluid communication occurs when sleeve means 82 has been shifted to its second position and does not occur when sleeve means 82 is in its first position. Port means 132 extends through sleeve section 82*f* and communicates between port means 78 and the flow path 32 to provide communication between control conduit means 22 and the flow path 32 at one location. Port means 134 extend through sleeve sections 82*a* and 82*c* and communicate between port means 98 and the flow path 32 to provide communication between balance conduit means 24 and the flow path 32 at another location in the flow path 32 spaced from the above mentioned one location. Inwardly facing seal bore means are provided within the safety valve 18 at spaced longitudinal locations therein. Seal means carried by a tool train engage the seal bore means. Control fluid is thereby confined and capable of affecting operation of a secondary valve. For the illustrated safety valve 18, a first seal bore means 136 is formed on the inwardly facing surface of sleeve section 82*a.* Port means 132 opens substantially at the longitudinal mid point of the seal bore means 136. A second seal bore means 138 is formed on tubular housing section 30*a* slightly above the upper extremity of sleeve section 82*f.*

Valve housing means 30 additionally includes lock recess means 140. The lock means of a tool train can engage the lock recess means 140 and lock the tool train within the flow path 32 of the safety valve 18.

If for any reason, the tool train and secondary valve are retrieved from the well, it may be desirable to prevent fluid communication between the control conduit means 22 and 24 and leave the safety valve 18 locked open. To do so, valve sleeve means 82 is shifted from its second position to its first position and lock sleeve means 112 remains in its second position.

Detent means selectively detents valve sleeve means 82 in one of its first and second positions, prevents valve sleeve means 82 from inadvertently shifting to the other of its first and second positions, and permits valve sleeve means 82 to be shifted upon the application of a select force. The detent means comprises resilient detent ring means 141 carried in an inwardly facing recess 143 of housing means 30. Detent ring means 141 is resiliently contractible and expandable and inherently contracts radially inwardly. Valve sleeve means 82 has formed therein spaced detent groove means 145 and 147 facing radially outwardly. One 145 of the two groove means 145 and 147 is engaged by detent ring means 141 when valve sleeve means 82 is in its first position. The other 147 is engaged by detent ring means 141 when valve sleeve means 82 is in its second position.

FIGS. 3A and 3B illustrate a tool train 142 positioned within the flow path 32 of the safety valve 18. The tool train 142 is capable of engaging and simultaneously moving the lock means and valve means to their second position, locking itself against longitudinal movement with respect to housing means 30, and controlling the flow through the flow path 32 in response to pressurization of the same conduit means which formerly controlled safety valve 18. One section of the tool train 142 comprises shifting tool means 144. Shifting tool means 142 includes key means 146. Key means 146 have an outer profile configured to mate with the inwardly facing profile 130 of sleeve section 82*f*. Engagement of key means 146 with sleeve means 82 enables the tool train 142 to shift the valve means and lock means of the safety valve 18 to their second position.

The tool train 142 also includes latch means 148 for latching the tool train 142 in the safety valve 18. The latch means 148 engages the lock recess means 140 once the valve means and lock means have been shifted to their second position. Thereafter, the latch means 148 prevents relative upward movement of the tool train 140 with respect to valve housing means 30. The continued engagement of key means 146 with sleeve means 82 prevents relative downward movement of the tool train with respect to valve housing means 30.

The tool train 140 also includes secondary valve means 150. Secondary valve means 150 includes body means 152, plug means 154 and control means 156. Body means 152 carries spaced seal means 158. Seal means 158 are adapted to sealingly engage seal bore means 130 and seal between sleeve means 82 and body means 152. When secondary valve means 150 has been landed and locked in the safety valve 18, fluid flow through the flow path 32 is further confined to the passageway means 160 extending through body means 152. Plug means 154 controls flow through the passageway means 160. Plug means 154 is movable between a first position (not shown) closing the passageway means 160 and a second position (shown in FIG. 3B) opening the passageway means 160. Control means 156 moves the plug means 154. Control means 156 is biased to a first position by yieldable biasing means 162. When control means 156 is in its first position, plug means 154 is also in its first position. Piston means 164 associated with control means 156 is affected by pressurized fluid and creates a pressure force capable of moving control means to a second position. Movement of control means 156 to its second position moves plug means 154 to its second position. Port means 166 extends laterally through body means 152 and permits hydraulic control fluid to be communicated to the upper side of piston means 164. Port means 168 extends laterally through body means 152 and permits hydraulic control fluid to be communicated to the lower side of piston means 164. The tool train carries spaced seal means for confining the hydraulic control fluid and enabling such fluid to communicate with port means 166 and 168, respectively. The spaced seal means 158*a* and 158*b* span port means 168. When the secondary valve means 150 is landed in the safety valve 18, the spaced seal means 158*a* and 158*b* also span port means 134. Hydraulic control fluid from balance conduit means 24 is thereby confined to the underside of piston means 164. The tool train includes a section carrying seal means 170. Seal means 170 engages seal bore means 132. Seal means 170 in conjunction with seal means 158*a*, due to the fact that the tool train sections between seal means 170 and seal means 158*a* are interconnected in a fluid-tight manner, confine hydraulic control fluid from control conduit means 22. Communication between control conduit means 22 and the upper side of piston means 164 is thereby permitted.

In operation, the safety valve 18 is utilized to control subsurface flow in the well. In the event that the safety valve 18 malfunctions, the safety valve 18 can be locked in the open position and the control conduits isolated from the valve's pressure responsive actuator. Once the conduits are isolated from the actuator, the conduits may be utilized to control a secondary valve 150.

A safety valve 18 is normally closed. As long as the pressure of control fluid remains below a select value, biasing or urging means 48 maintains operator means 46 in its first position. Operator means 46 in turn maintains closure means 34 in its first position closing the flow path 32 through valve housing means 30.

Hydraulic control fluid within control conduit means 22 is pressurized to open the safety valve 18. The pressurized hydraulic control fluid communicates between control conduit means 22 and control pressure chamber means 66. The pressurized control fluid within control pressure chamber means 66 produces a pressure force which urges operator means 46 downwardly towards its second position. When the pressure of control fluid within control pressure chamber means 66 reaches a select value, operator means 46 moves to its second position. Movement of operator means 46 in turn moves closure means 34 to its second position. Passage means 44 becomes aligned with the flow path 32. A full open bore through housing means 32 is thereby provided.

If the pressure of control fluid within control pressure chamber means 66 should drop below a select value, closure of the safety valve 18 is initiated. Spring means 48 moves operator means 46 upwardly towards its first position. Several fluid forces retard such upward movement of operator means 46. One such force is a pressure force created by the hydrostatic head of fluid within control conduit means 22. That hydrostatic pressure force may be balanced by a corresponding column of fluid within balance conduit means 24. Control fluid communicates between balance conduit means 24 and balance pressure chamber means 68. Pressurized control fluid within balance pressure chamber means 68 produces a pressure force tending to urge operator means 46 upwardly to its first position. If desired, the fluid within balance conduit means 24 may be pressurized by operating manifold 20 to further assist movement of operator means 46 to its first position. When operator means 46 has been returned to its first position, the closure means 34 has returned to its first, flow path closing position.

In the event that the valve 18 malfunctions, a tool train 142 is run downwardly through the bore of the tubing string 12. Shifting tool means 144 of the tool train 142 engages sleeve means 82. Further downward movement of the tool train 142 is initially arrested by shear pin means 114. A downward force is applied to the tool train 142. Shear pin means 114 shears. Simultaneously, the tool train 140 moves lock means to lock open the safety valve 18 and moves isolation valve means to block fluid communication between the conduit means and the safety valve's pressure responsive actuator. Valve sleeve means 82 is moved downwardly to its second position by the tool train 142. Seal means 84 and 102 block fluid communication between the control conduit means 22 and control pressure chamber means 66 and between balance conduit means 24 and balance conduit means 68, respectively. Downward movement of sleeve means 82 to its second position moves lock sleeve means 112 to its second position. Lock sleeve means 112 engages operator means 46 and moves it downwardly to its second position. When lock sleeve means 112 is in its second position, lock ring means 116 contracts radially into lock recess means 120 and locks lock sleeve means 112 in its second position. The safety valve 18 is thereby locked in its open position.

Latch means 148 engages lock recess means 140. The tool train 142 is thereby locked within valve housing means 30 and cannot move longitudinally therein. Secondary valve means 150, forming a portion of the tool train 140, may not be controlled to control subsurface flow through the well. The secondary valve means 150 is normally closed. Whenever the pressure of control fluid within control conduit means 22 is below a minimal value, biasing means 162 maintains control means 156 in its first position. Control means in turn maintains plug means 154 in its first position blocking fluid flow through passageway means 160.

Control fluid within control conduit means 22 is pressurized to open the secondary valve means 150. The pressurized control fluid communicates between control conduit means 22 and the upper side of piston means 164 through port means 78 of housing means 30, port means 132 is the sleeve means 82*f*, and port means 166 in body means 152. Whenever the control fluid within control conduit means is pressurized at least to a minimal value, the downwardly acting pressure force exerted upon piston means 164 by the control fluid moves control means 156 to its second position. Control means 156 in turn moves plug means 154 to its second position opening the passageway means 160.

Whenever the pressure of control fluid within control conduit means 22 reduces below a minimal value, for whatever reason, closure of the secondary valve 150 is initiated. Biasing means 162 exerts an upwardly acting force on control means 156. An upwardly acting pressure force may also be exerted upon piston means 164 due to the presence of fluid within balance conduit means 24. These upwardly acting force return the control means 156 to its first position. The control means 156 in turn moves plug means 154 to its first position. The passageway means 160 through the secondary valve means 150 is blocked.

The details of a second embodiment of a tubing retrievable surface controlled subsurface safety valve is structured in accordance with this invention are illustrated in FIGS. 6A through 6D. The illustrated valve is open.

The subsurface valve 200 includes housing means 202 for defining the controlled subsurface flow path 204. Closure means 206 controls flow through the flow path 204. Pressure responsive actuator means moves the closure means 206. The valve includes communicating means adapted to extend between the conduit means 22 and 24 and a region within the valve wherein the control fluid can affect the actuator means. If the illustrated safety valve 200 malfunctions, shiftable means simultaneously lock the valve 200 open and valve isolate the communicating means. Communication of control fluid between the control conduit means 22 and 24 and the actuator means is thereby prevented.

Valve housing means is adapted to be made up in the tubing string 22 and form a portion thereof. Housing means 202 includes longitudinally extending bore means 204 for defining the controlled subsurface flow path 204 when the valve 200 is positioned within the tubing string 12. The illustrated housing means 202 is formed from interconnected tubular sections 202*a*, 202*b*, 202*c*, 202*d*, 202*e*, 202*f*, 202*g* and 202*h*. Closure means 206 controls flow through the controlled flow path 204. Closure means 206 is movable between a first position (not shown) closing the flow path 204 and a second position (shown in FIG. 6D) opening the flow path 204. The illustrated closure means 206 is an axially movable and rotatable ball valve element 206 whose structure and operation are well known to those skilled in the design of subsurface tubing safety valves.

Pressure responsive actuator means controls movement of the closure means 206. The actuator means is movable between a first position wherein the closure means 206 is in its first position and a second position wherein the closure means 206 is in its second position. The actuator means is normally in its first position. Movement of the actuator means to its second position occurs in response to pressurization of control fluid within control conduit means 22.

Actuator means comprises movable operator means 208, yieldable urging means 210 and pressure responsive means.

Operator means 208 is longitudinally movable with respect to housing means 202. Operator means 208 comprises control tube sections 208*a*, 208*b* and 208*c*; seat means 208*d*; control finger means 208*e*; and guide means 208*f*. Seat member means 208*d* coacts with closure means 206 to block upward fluid flow through the flow path 204 when the closure means and operator means 208 are in their first position in a well known manner. Yieldable urging means, such as the two coil compression spring means 210 and 210*a* yieldably urge operator means 208 towards its first position. To move the operator means 208 towards its second position, the yieldable urging means 210 and 210*a* must be overpowered.

Pressure responsive means moves the operator means 208 towards its second position. Seal means 212 and 214 carried by housing means 202 and seal means 216 carried by operator means 208 define two pressure chambers 218 and 220. The pressure of fluid within one pressure chamber 218 tends to move operator means 208 towards its second position while the pressure of fluid within the other pressure chamber 220 tends to move operator means 208 towards its first position. In accordance with this invention, initially control fluid communicates between control conduit means 22 and the one pressure chamber 218 and balance fluid communicates between balance conduit means 24 and pressure chamber means 220.

Communicating means communicate control fluid between the conduit means and the pressure responsive means of the safety valve 200. One communicating means extends between control conduit means 22 and pressure chamber means 218 and another communicating means extends between balance conduit means 24 and pressure chamber means 220. Positioned within housing means 202 is a packing cylinder 222 and sleeve means 224. Sleeve means 224 carries seal means 226, 228, 230, 232 and 234 which seal between packing cylinder 222 and sleeve means 224. Two longitudinally extending annular channel means 236 and 238 are formed in the outer surface of sleeve means 224 between sleeve means 224 and packing cylinder 222. Nipple means 240 is attached to the outer surface of housing means 202 and includes an internal passage 242. The passage 242 communicates with port means 244 extending laterally through housing means 202. In turn, the port means 204 communicate with port means 246 in packing cylinder 222. Port means 246 opens into channel means 236. Duct means 248 is also attached to housing means 202. Duct means 248 communicates with port means 250 extending laterally through housing means 202. Port means 250 in turn communicate with port means 252 in packing cylinder 222. Port means 252 opens into channel means 236. Duct means extends longitudinally to a location adjacent to pressure chamber 218. Port means 254 extend through housing means 202 and communicate between duct means 248 and chamber means 218. Thus, initially, fluid communication between control conduit means 22 and chamber means 218 occurs through passage means 242, port means 244, port means 246, channel means 236, port means 252, port means 250, duct means 248 and port means 254. The fluid communication between balance conduit means 24 and pressure chamber 220 occurs through passage means 256 in nipple 258, port means 260 extending through housing means 202, port means 262 extending through packing cylinder 222, channel means 238, port means 264 formed in packing cylinder 222 and opening in channel means 238, port means 266 extending through housing means 202, duct means 268 extending longitudinally along housing means 202, and port means 270 extending through housing means 202 between duct means 268 and chamber means 220. It should be noted that seal means 230 and 232 prevent communication between the channel means 236 and 238 and thereby prevent comingling of fluid from the control conduit means 22 and the balance conduit means 24.

Valve 200 includes means for simultaneously locking the closure means 206 in its second position and for valving the communicating means to block fluid communication between the control conduit means and the pressure responsive means.

To lock the closure means 206 in its second position, operator means 208 is engaged, moved to its second position, and locked in that position. The simultaneous locking and valving means includes sleeve means 224 which engages, moves and locks operator means 208. Sleeve means 224 is initially held in a first position (as illustrated) where it does not interfere with the normal movement and operation of operator means 208. Shear pin means 272 releasably hold sleeve means 224 in its first position. Sleeve means 224 undergoes sufficient longitudinal movement with respect to housing means 202 that upon being moved to its second position, it has moved operator means 208 to its second position. The closure means is thereby moved to its second position. Sleeve means 224 is locked in its second position by the engagement of lock ring means 274 with lock recess means 276.

The movement of sleeve means 224 to its second position causes seal means 228 to become disposed between port means 246 and 252 and causes seal means 232 to become disposed between port means 262 and 264. Fluid flow between the control conduit means 22 and chamber means 218 and between balance conduit means 24 and chamber means 220 is thereby prevented.

Sleeve means 224 includes a radially inwardly facing profile 278 which is adapted to be engaged by a shifting tool so that the sleeve means 224 may be shifted from its first position to its second position.

The tool train which includes the shifting tool for shifting the sleeve means 224 to its second position may also include a secondary valve which when landed, locked and sealed in the tubing retrievable valve 200, may thereafter control subsurface flow through the well. To permit control fluid communication to that secondary valve, sleeve means 224 includes laterally extending port means 280 and 282. When sleeve means 224 is in its second position, port means 280 communicates with port means 246. Therefore, port means 280 is in communication with control conduit means 22. In a similar manner, when sleeve means 224 is in its second position, port means 282 communicates with port means 262. It therefore is in communication with balance conduit means 24. The internal wall of sleeve means 224 and of housing means 202 is designed to have spaced seal bore means 284, 286 and 288 so that a secondary valve may seal therewith and properly confine control fluid so that the control fluid may be effective to operate the secondary valve.

The housing means 202 also includes spaced locking groove means 290 and 292 for coacting with the locking mandrel of the secondary valve to lock the secondary valve in position.

In operation, the safety valve 200 is utilized to control subsurface flow in a well. Normally, the valve 200 is closed. As long as the pressure of control fluid within chamber means 218 remains below a select value, urging means 210 and 210*a* maintain the closure means 206 in its first position.

Pressurization of control fluid within control conduit means at least to a select value will open the safety valve 200. The pressurized hydraulic control fluid communicates between control conduit means 22 and control pressure chamber means 218. The pressurized control fluid moves operator means 208 downwardly and thereby moves closure means 206 to its second, full open position. If the pressure of control fluid within chamber means 218 drops below the select value, closure of the safety valve 200 is initiated. Urging means 210 and 210*a* move operator means 208 upwardly. The closure means 206 is in turn moved to its first position. If desired, the pressure of fluid within balance conduit means 24 may be increased to assist upward movement of operator means 208. That pressurized fluid communicates between balance conduit means 24 and pressure chamber means 220.

If valve 200 malfunctions, a tool train is run downwardly through the bore of the tubing string 12. The tool train would include a shifting tool, a secondary valve and a lock mandrel. The shifting tool will engage the shifting profile 278 of sleeve means 224. A downward application of force to the tool train will shear shear pin means 234 and shift sleeve means 224 to its second position. Sleeve means 224 will become locked in its second position due to lock ring means 74 snapping radially inwardly into lock groove means 276. The shifting of sleeve means 224 to its second position simultaneously moves the closure means to its second position and isolates the communicating means to prevent further fluid communication between the control conduit means 22 and 24 and the pressure chamber means 218 and 220. Thereafter, the lock mandrel of the tool train will engage the locking grooves 290 and 294. The secondary valve will become sealed within the valve housing 202. Control fluid will communicate with that secondary valve. Its operation may therefore be controlled by pressurizing control fluid within the same conduit means 22 and 24 which had formerly communicated control fluid to the malfunctioned tubing retrievable valve 200.

From the foregoing, it can be seen that the objects of this invention have been obtained. The subsurface safety valve of this invention is control pressure actuated. The safety valve may be locked in the open position and the valve's pressure responsive actuator isolated from hydraulic control fluid with a single trip and a single operation of a well tool train. The pressure responsive actuator may be isolated from both the control conduit which is pressurized to open the safety valve and the balance conduit. Once the valve's pressure responsive actuator has been isolated from the sources of hydraulic control fluid, a second valve may be controlled by the same conduit(s) which formerly controlled the locked out valve. Control of that second valve is more assured than has heretofore been possible. Heretofore, seal failure of the tubing retrievable valve's pressure responsive actuator prevented the maintenance of sufficient control fluid pressure for controlling the secondary valve. With the isolation feature of the valve of this invention, control fluid pressure can be maintained. Additionally, the isolation feature prevents high pressure well fluids from escaping past the failed seals of the valve's pressure responsive actuator and into the control conduit. Possible well blowouts are thereby prevented.

The foregoing disclosure and description of the invention are illustrative and explanatory thereof. Various changes in the size, shape and materials, as well as the details of the illustrated construction, may be made within the scope of the appended claims without departing from the spirit of the invention.

What is claimed is:

1. A surface controlled subsurface safety valve comprising:

housing means for defining a flow path;

closure means for controlling flow through said flow path;

actuator means for controlling movement of said closure means and including:

operator means longitudinally movable with respect to said housing means and having a first position wherein said closure means prevents flow and a second position wherein said closure means permits flow, fluid pressure responsive means for moving said operator means from said first position to said second position when affected by fluid pressurized at least to a selected value;

means for communicating control fluid between a control conduit and said pressure responsive means;

means for simultaneously moving said operator means to said second position and for preventing flow through said communicating means.

2. The safety valve of claim 1 wherein said means for simultaneously moving said operator means and for preventing flow comprises:

lock sleeve means movable with respect to said housing means between a first position not interferring with movement of said operator means and a second position wherein said operator means is moved to its second position;

means for locking said lock sleeve means in its second position;

isolation valve sleeve means movable with respect to said housing means between a first position permitting flow through said communicating means and a second position preventing flow through said communicating means; and wherein said lock sleeve means and said isolation valve sleeve means abut when both are in their respective first positions and during the movement of both towards their second position.

3. The safety valve of claim 1 wherein said means for simultaneously moving said operator means and for preventing flow comprises:

sleeve means movable with respect to said housing means between a first position and a second position;

said sleeve means when in said first position not interferring with movement of said operator means and permitting fluid flow through said communicating means;

said sleeve means when in said second position maintaining said operator means in its second position and preventing fluid flow through said communication means; and means for locking said sleeve means in its second position.

4. The safety valve of claim 1 wherein said communicating means includes:

first port means extending laterally through said housing means and adapted to be in communication with a conduit;

longitudinal channel means formed in said housing means;

said first port means opening at one longitudinal end of said channel means;

second port means extending laterally through said housing means and opening at the other longitudinal end of said channel means;

duct means extending longitudinally with respect to said housing means;

said second port means opening at one longitudinal end of said duct means; and third port means extending laterally through said housing means and communicating between said duct means at the other longitudinal end thereof and said pressure responsive means.

5. Surface controlled subsurface safety valve comprising:

housing means for defining a flow path;

closure means for controlling flow through said flow path;

operator means longitudinally movable with respect to said housing means for moving said closure means and having a first position wherein said closure means closes said flow path and having a second position wherein said closure means opens said flow path;

control fluid pressure responsive means for moving said operator means from said first position to said second position when affected by fluid pressurized at least to a selected value;

balance fluid pressing responsive means for pressure balancing said operator means with respect to hydrostatic fluid pressure;

control fluid communicating means for communicating control fluid between a control conduit and said control fluid pressure responsive means;

balance fluid communicating means for communicating pressure balancing fluid between a conduit and said balance fluid pressure responsive means;

means for simultaneously locking said operator means in said second position and for valving both of said control fluid communicating means and said balance fluid communicating means to block fluid flow therethrough.

6. The safety valve of claim 5 wherein said means for simultaneously locking said operator means and for valving both of said communicating means comprises:

lock sleeve means movable with respect to said housing means between a first position not interferring with movement of said operator means and a second position wherein said operator means is moved to its second position;

means for locking said lock sleeve means in its second position;

valve sleeve means movable with respect to said housing means between a first position permitting flow through both of said communicating means and a second position preventing flow through both of said communicating means; and wherein said lock sleeve means and said valve sleeve means abut when both are in their respective first positions and during the movement of both towards their second position.

7. The safety valve of claim 5 wherein said means for simultaneously locking said operator means and for valving both of said communicating means comprises:

sleeve means movable with respect to said housing means between a first position and a second position;

said sleeve means when in said first position not interferring with movement of said operator means and permitting fluid flow through both of said communicating means;

said sleeve means when in said second position maintaining said operator means in its second position and preventing fluid flow through both of said communicating means; and means for locking said sleeve means in its second position.

8. The safety valve of claim 5 wherein each of said communicating means includes:

first port means extending laterally through said housing means and adapted to be in communication with a conduit;

longitudinal channel means formed in said housing means;

said first port means opening at one longitudinal end of said channel means;

second port means extending laterally through said housing means and opening at the other longitudinal end of said channel means;

duct means extending longitudinally with respect to said housing means;

said second port means opening at one longitudinal end of said duct means;

third port means extending laterally through said housing means and communicating between said duct means at the other longitudinal end thereof and said pressure responsive means; and wherein each of said first port means, channel means, second port means, duct means and third port means for each of said communicating means are longitudinally offset from each other so that fluids do not communicate between said control fluid communicating means and said balance fluid communicating means.

9. Surface controlled subsurface safety valve comprising: housing means for defining a flow path;

closure means for controlling flow through said flow path;

operator means longitudinally movable with respect to said housing means moving said closure means and having a first position wherein said closure means closes said flow path and having a second position wherein said closure means opens said flow path;

control fluid pressure responsive means for moving said operator means from said first position to said second position when affected by fluid pressurized at least to a selected value;

balance fluid pressure responsive means for pressure balancing said operator means with respect to hydrostatic fluid pressure;

control fluid communicating means for communicating control fluid between a control conduit and said control fluid pressure responsive means;

balance fluid communicating means for communicating pressure balancing fluid between a conduit and said balance fluid pressure responsive means;

means for simultaneously locking said operator means in said second position and for valving both of said control fluid communicating means and said balance fluid communicating means to prevent communication between a control conduit and said control fluid pressure responsive means, to prevent communication between a conduit and said balance fluid pressure responsive means, to permit communication between a control conduit and said flow path and to permit communication between a balance conduit and said flow path.

10. The safety valve of claim 9 wherein said means for simultaneously locking said operator means and for valving both of said communicating means comprises:

lock sleeve means movable with respect to said housing means between a first position not interferring with movement of said operator means and a second position wherein said operator means is moved to its second position;

means for locking said lock sleeve means in its second position;

valve sleeve means movable with respect to said housing means between a first position permitting flow through both of said communicating means and a second position preventing flow through both of said communicating means; and wherein said lock sleeve means and said valve sleeve means abut when both are in their respective first positions and during the movement of both towards their second position.

11. The safety valve of claim 9 wherein said means for simultaneously locking said operator means and for valving both of said communicating means comprises:

sleeve means movable with respect to said housing means between a first position and a second position;

said sleeve means when in said first position not interferring with movement of said operator means and permitting fluid flow through both of said communicating means;

said sleeve means when in said second position maintaining said operator means in its second position and preventing fluid flow through both of said communicating means; and means for locking said sleeve means in its second position.

12. The safety valve of claim 9 wherein each of said communicating means includes:

first port means extending laterally through said housing means and adapted to be in communication with a conduit;

longitudinal channel means formed in said housing means;

said first port means opening at one longitudinal end of said channel means;

second port means extending laterally through said housing means and opening at the other longitudinal end of said channel means;

duct means extending longitudinally with respect to said housing means;

said second port means opening at one longitudinal end of said duct means;

third port means extending laterally through said housing means and communicating between said duct means at the other longitudinal end thereof and said pressure responsive means; and wherein each of said first port means, channel means, second port means, duct means and third port means for each of said communicating means are longitudinally offset from each other so that fluids do not communicate between said control fluid communicating means and said balance fluid communicating means.

* * * * *